US005513511A

United States Patent [19]

Imae et al.

[11] Patent Number: 5,513,511

[45] Date of Patent: May 7, 1996

[54] METHOD OF PRODUCING SEAMLESS STEEL TUBE BY USING MANDREL MILL

[75] Inventors: Toshio Imae; Hiromu Oka, both of Chiba, Japan

[73] Assignee: Kawasaki Steel Corporation, Hyogo, Japan

[21] Appl. No.: 231,333

[22] Filed: Apr. 22, 1994

Related U.S. Application Data

[63] Continuation-in-part of Ser. No. 931,939, Aug. 18, 1992, abandoned.

[30] Foreign Application Priority Data

Aug. 22, 1991 [JP] Japan ..... 3-233835

[51] Int. Cl.[6] ..... B21B 17/04

[52] U.S. Cl. ..... 72/208; 72/370

[58] Field of Search ..... 72/208, 209, 252.5, 72/370, 235

[56] References Cited

U.S. PATENT DOCUMENTS

| | | | |
|---|---|---|---|
| 1,858,990 | 5/1932 | Foren | 72/208 |

FOREIGN PATENT DOCUMENTS

| | | | |
|---|---|---|---|
| 112106 | 8/1980 | Japan | 72/209 |
| 0030015 | 3/1981 | Japan | 72/208 |
| 0224155 | 12/1983 | Japan . | |
| 0106603 | 6/1985 | Japan . | |
| 0263804 | 11/1987 | Japan | 72/252.5 |
| 0012683 | 3/1988 | Japan | 72/252.5 |
| 0049309 | 3/1988 | Japan | 72/252.5 |
| 0084720 | 4/1988 | Japan . | |
| 0186205 | 7/1989 | Japan . | |
| 0284411 | 11/1989 | Japan . | |
| 825215 | 4/1981 | U.S.S.R. | 72/209 |
| 973199 | 11/1982 | U.S.S.R. | 72/252.5 |

OTHER PUBLICATIONS

Lankford, Jr., et al., "*The Making, Shaping and Treating of Steel*", 1985, 10th Edition Association of Iron and Steel Engineers, pp. 1044–1047.

Neumann et al., "*Stahlrohrherstellung*", 1970, 3rd Edition, Deutscher Verlag Für Grundstoffindustrie, pp. 162–183.

*Primary Examiner*—Lowell A. Larson
*Assistant Examiner*—Thomas C. Schoeffler
*Attorney, Agent, or Firm*—Dvorak and Traub

[57] ABSTRACT

A mandrel mill for rolling seamless steel tubes includes a plurality of roll stands each having a pair of rolls defining a roll groove therebetween, an axis of the rolls of each roll stand being orthogonal to the axis of the rolls of the adjacent roll stands. The mandrel mill further includes a mandrel bar disposed in the roll grooves configured by the roll stands. The ratio between the radius of curvature of a groove bottom of the groove and a distance between the groove bottom of the roll groove of the first stand ranges from 0.46 to 0.54, and that of the second stand ranges from 0.48 to 0.52.

3 Claims, 5 Drawing Sheets

METHOD OF PRODUCING SEAMLESS STEEL TUBE BY USING MANDREL MILL

This is a continuation-in-part of application U.S. Ser. No. 07/931,939 filed 18 Aug. 1992, now abandoned.

BACKGROUND OF THE INVENTION

1. Field of the Invention

The present invention relates to a method for preventing defects such as holes from being formed on surfaces of blank tubes manufactured by mandrel mill, wherein the holes are produced during the manufacturing of the seamless steel tubes, and more particularly during the manufacturing seamless steel tubes made of a high alloy steel such as stainless steel and has a shell wall thickness-to-outside diameter ratio of not greater than 0.025.

2. Description of the Related Art

In one method of manufacturing seamless steel tubes using a mandrel mill, a heated billet is pierced by a piercing machine, and a finishing rolling process of the billet is applied by rolling the inside of the tube. As is shown in FIG. 4, the mandrel mill employed in this circumstance normally comprises a plurality of—from five to eight—roll stands 1 configuring a roll groove having a plurality of rolls 2 and 2' in alternate pairs arranged horizontally and vertically.

These plurality of grooved roll stands are disposed orthogonally about a rolling shaft, and a mandrel bar 3 is disposed within a roll groove formed by roll stands 1. The inner surface of the blank tube 4 is rolled by the mandrel bar 3.

In the manufacturing of seamless steel tubes by mandrel mill, holes are often formed on surfaces of the blank tubes 4 during the rolling process causing unfavorable defects in the mandrel mill manufacturing. (Hereinafter, this defect is referred to as the "hole defect" and reference numeral 6 indicates the portions with the "hole defect.")

Conventionally, it was thought that the "hole defect" was caused by the following reasons. As is shown in FIG. 5, when a blank tube made of a high alloy steel, such as stainless steel, is rolled by the mandrel mill at a temperature ranging between 950° C. and 1050° C. which is the normal rolling temperature range for common blank tubes, the hot-working characteristics of the blank tube deteriorates.

When a blank tube having an inferior hot-working characteristic is rolled by the mandrel mill, a longitudinal tensile force is exerted only on a flange portion 5 shown in FIG. 2 of the blank tube receiving no reduction, which eventually causes a rupture or "hole defect" in the tube. These defects tend to occur with much greater frequency in steel tubes having a thin wall thickness. This tendency is particularly remarkable in products which have shell wall thickness-to-outside diameter ratio of not greater than 0.0.25.

Various method for preventing the "hole defect" have been proposed.

One of the common methods for preventing the "hole defect" is disclosed in Japanese Patent Laid-Open Publication No.58-224155, wherein a method of improving the hot-working deformability of the rolling tube materials is proposed.

There is also proposed, in Japanese Laid-Open Publication No.63-84720, a method of reducing the rolling reduction of one stand where the "hole defect" occurs in the mandrel mill and dispersing the reduction load to the remaining stands, and of reducing the wall thickness of blank tubes at the entrance of the mandrel mill so as to reduce the rolling reduction of each stand of the mill.

The method disclosed in Japanese Patent Laid-Open Publication No.58-22455, however, cannot provide a sufficient hot-working deformability at rolling temperatures in the range of 950° C. to 1050° C. in the mandrel mill.

Although the method proposed in Japanese Patent Laid-Open Publication No.63-84720 can prevent the "hole defect", it may not be used on blank tubes with a thin wall thickness for the following reason:

If after reduction loads are dispersed to each stand, and there remains a stand in which the rolling load exceeds the reference value, the wall thickness of the blank tube is reduced at the entrance of the mandrel mill so as to reduce the rolling reduction of each stand of the mill. However, rolling reduction on the blank tube by the piercing machine is limited and therefore the wall thickness of the blank tube cannot be reduced below a lower limit. In the above situation, it is difficult to roll blank tubes with a thin wall thickness.

Accordingly, an object of the present invention is to overcome the above described problems of the mandrel mill and prevent the "hole defect."

SUMMARY OF THE INVENTION

The present invention is directed toward a roll groove design of a row of stands consecutively disposed in the mandrel mill by limiting the rolling reduction to prevent the "hole defect" produced during the rolling process.

According to the present invention, there is provided a mandrel mill for rolling seamless steel tubes which comprises a plurality of roll stands each having a pair of rolls defining a roll groove therebetween, the rolls being arranged such that the axis of the rolls of each roll stand is orthogonal to the axis of the rolls of the adjacent roll stand, and a mandrel bar disposed in the roll groove configured by the roll stands wherein the ratio between the radius of curvature of groove bottom and a distance between the groove bottom of the roll groove of a first stand ranges from 0.46 to 0.54.

According to the present invention there is provided a mandrel mill for rolling seamless steel tubes, comprising a plurality of roll stands each having a pair of rolls defining a roll groove therebetween, the rolls being arranged such that the axis of the rolls of each roll stand is orthogonal to the axis of the rolls of the adjacent roll stand, and a mandrel bar disposed in the roll groove configured by the roll stands wherein the ratio between the radius of curvature of groove bottom and a distance between the groove bottom of the roll groove of a second stand ranges from 0.48 to 0.52.

According to the present invention there is also provided a mandrel mill for rolling seamless steel tubes, comprising a plurality of roll stands each having a pair of rolls defining a roll groove therebetween, the rolls being arranged such that the axis of the rolls of each roll stand is orthogonal to the axis of the rolls of the adjacent roll stands, and a mandrel bar disposed in the roll groove configured by the roll stands wherein the ratio between the radius of curvature of groove bottom and a distance between the groove bottom of the roll groove of the first stand ranges from 0.46 to 0.54, and that of the second stand ranges from 0.48 to 0.52.

DESCRIPTION OF THE PREFERRED EMBODIMENTS

As a result of the survey for the cause of the "hole defect" in a mandrel mill rolling, the present invention has been brought to discover a new mechanism of hole occurrence which is not disclosed in the prior art except as described above.

In a reduced portion of roll groove bottom, when a rolling reduction of bottom center groove is smaller than that of both sides of the center groove, the lack of material on the bottom center groove causes the necking phenomenon during the process of a rolling. Under this circumstance, the tube wall thickness becomes thin which, in an extreme case, will produce a hole.

This tendency is particularly remarkable in products which have shell wall thickness-to-outside diameter ratio of not great than 0.025.

Figure 2A:
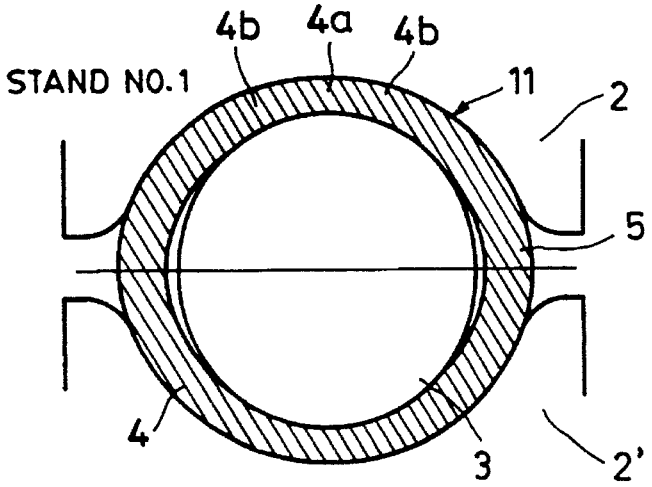
FIG. 2 illustrates a rolling reduction which becomes smaller at the bottom center of a groove and larger at both sides of the center in the third stand of a mandrel mill.
Figure 2B:
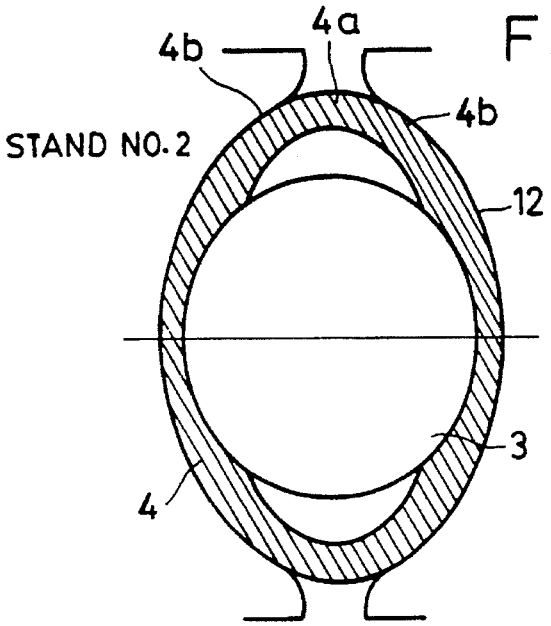
Figure 2C:
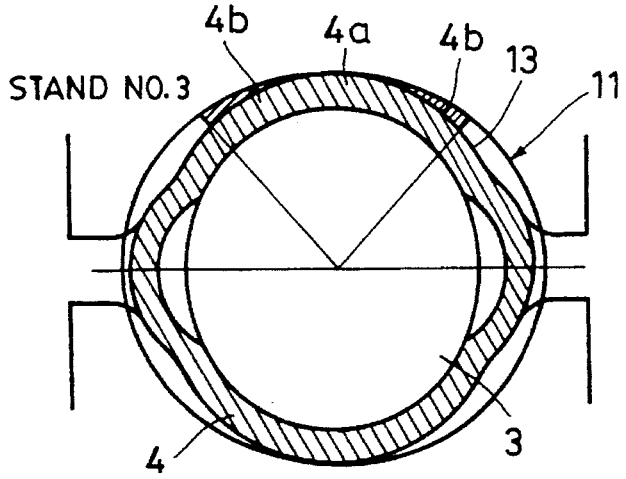

FIG. 2 illustrates an embodiment of the present invention in which the rolling reduction of both sides of the bottom center groove portion is greater than that of the center groove. In FIG. 2, reference numerals 2,2' indicate a roll groove defined by a pair of rolls, reference numeral 3 indicates a mandrel bar, and reference numeral 4 indicates a blank tube (a portion filled by slant bars in the FIG. 2).

Reference numeral 4*a* indicates the thinnest portion of the blank tube wall thickness, which is also a roll bottom center groove portion in the first stand (the first stand refers to stand No.1 in FIG. 2). Reference numeral 4*b* indicates both sides of the bottom center groove portion 4*a*. Reference numerals 11, 12, and 13 indicate roll grooves of the first, the second, and the third stands, respectively.

For example, as shown in FIG. 2(*a*), the shape of the roll groove 11 of the first stand is normally elliptical and the mandrel bar 3 substantially round. The wall thickness of the tube 4 in the circumferential direction at the exit area of the first stand becomes thinnest in the roll bottom center groove portion 4*a*, and becomes thicker as you move away from the bottom center groove. As shown in FIG. 2(*b*), in the rolling process at the second stand, the wall-thickness distribution of the thinnest tube wall of the bottom center portion 4*a* and both sides 4*b* from the center portion rolled by the first stand can be maintained even after the tube passes the second stand because the thinner portion 4*a* and thicker portions 4*b* do not suffer reduction from the roll groove 12 of the second stand.

As shown in FIG. 2(*c*), in the third stand, the roll groove 13 is substantially round so as to provide a uniform distribution of the tube-wall-thickness in the circumferential direction. The distribution of the wall thickness at the exit area of the first stand shows that the bottom center groove 4*a* is thinner and both sides 4*b*, from the center groove, are thicker. In the third stand, the roll reductions of both sides 4*b* are greater than that of the center portion 4*a* in the third stand. Thus, the present invention has successfully investigated that the lack of the material along the bottom center groove portion 4*a* causes the necking phenomenon to reduce the tube-wall thickness, which eventually causes the "hole defect". The phenomenon that occurs in the third stand will also occur in the fourth stand. Due to the elliptical shape of the roll groove of the second stand, the wall thickness in the circumferential direction is thinnest in the tube bottom groove area and as the area goes away from the bottom center groove, the thickness increases in the second stand. The groove bottom portion rolled by the second stand does not suffer reduction in the third stand, in which the wall-thickness distribution of these portion can be maintained after the tube passes the third stand. In the fourth stand, the roll groove is substantially round to provide a uniform distribution of the tube-wall-thickness in the circumferential direction. The distribution of wall thickness at the exit area of the second stand shows that the wall thickness of the groove bottom is thinner and that of both sides from the groove bottom is thicker. The rolling reduction of both sides from the groove bottom center portion is greater than that of the groove bottom portion, which causes the "hole defect" due to the same reason as described above. To obtain the uniform wall thickness in the circumferential direction of the finished tube, the roll groove in the finishing stands of the mandrel mill is designed such that the groove bottom portion is substantially round. In normal mandrel mills, the above described finishing stands are disposed between the fourth stand and the sixth or eighth stands. In the first stand and the third stand, when even one roll-groove configuration has an elliptical shape, the rolling reduction of both sides from the groove bottom center portion has to be greater than that of the groove bottom portion to unify the wall thickness distribution in either one of the succeeding stands located after the above described stand having the elliptical-shaped roll groove.

Thus, the following measures have been taken to unify the rolling-reduction distribution in the circumferential direction of the groove bottom portions where the rolling force is applied.

Figure 1:
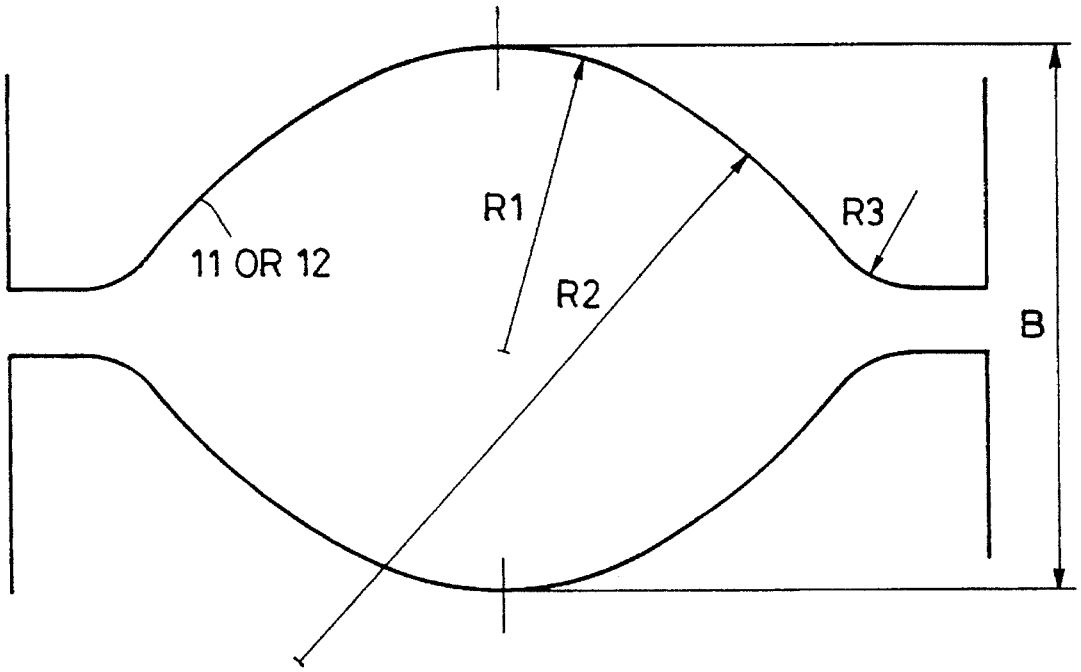
FIG. 1 is a cross sectional view of a roll groove defined by a pair of forming rolls according to the present invention.

The present invention has proposed a mandrel mill having a roll groove in which, as is shown in the representing illustration of FIG. 1, the groove bottom radius of curvature R1 in the first stand ranges from 0.46 to 0.54 of the groove bottom distance B of the pair of rolls, and the groove bottom radius of curvature R1 in the second stand ranges from 0.48 to 0.52 of the groove bottom distance B of the pair of rolls.

According to the present invention, "hole defect" which is caused by the non-uniformity of the groove bottom draft, a cause which has been overlooked by the prior art, can be prevented by providing an upper limit and a lower limit of the groove bottom radius of curvature in the front stands in the mandrel mill.

Namely, in the mandrel mill which has a tendency to cause the "hole defect" in the groove bottom of the third stand, the rolling reduction in the circumferential direction of the groove bottom in the third stand can be unified by designing the groove bottom radius of curvature of the roll groove in the first stand to range from 0.46 to 0.54 of the distance between the groove bottom of the pair of rolls in the first stand. Thus, "hole defect" can be practically eliminated. Likewise, in the mandrel mill which has a tendency to cause the "hole defect" in the groove bottom of the fourth stand, the rolling reduction in the circumferential direction of the groove bottom in the fourth stand can be unified by designing the groove bottom radius of curvature of the roll groove in the second stand to range from 0.48 to 0.52 of the distance between the groove bottom of the pair of rolls in the second stand. Thus, the occurrence of a "hole defect" can be practically eliminated.

Meanwhile, in the mandrel mill, it depends on the characteristics of the mill or the reduction distribution of each stand and the like whether a "hole defect" occurs in either one or both of the third and fourth stands.

Figure 3:
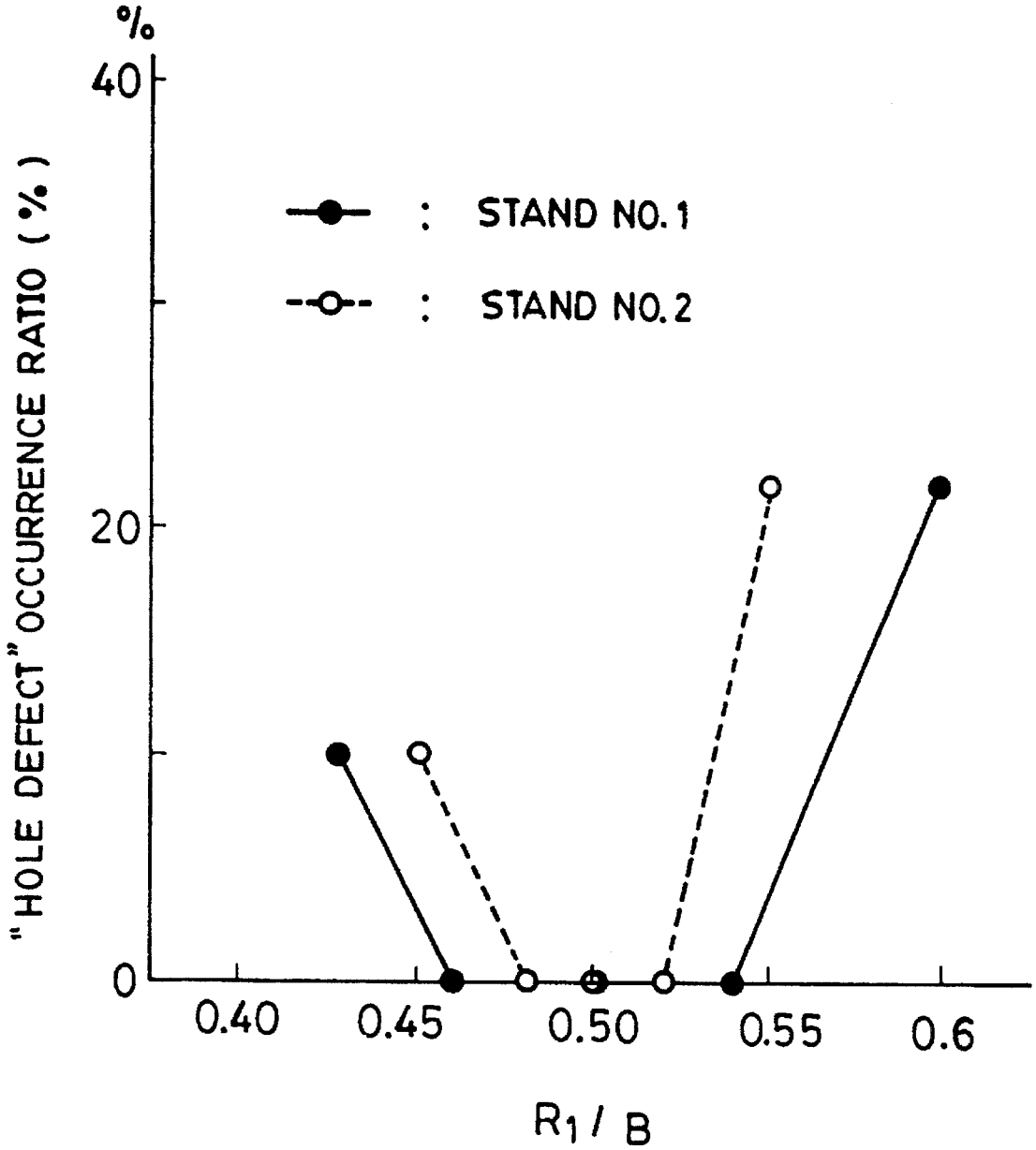
FIG. 3 illustrates the relation between a ratio of the groove bottom radius of curvature and a distance of the groove bottom of a pair of rolls and a ratio of defect occurrence.

Based on the testing results exhibited in FIG. 3, the ratios of the groove bottom radius of curvature R1 and the distance B between the groove bottom of the pair of rolls are determined as ranging from 0.46 to 0.54 in the first stand and from 0.48 to 0.52 in the second stand. The invention provides a method for producing a seamless steel tube by using the above-described grooved rolls while adopting the following control of rolling reductions.

More specifically, according to one aspect of the invention, the rolling in the first stand is conducted by using rolls defining said roll groove such that the ratio between the radius of curvature of the groove bottom and the distance between the bottoms of the groove ranges from 0.46 to 0.54, and that the rolling by the third stand is conducted such that the rolling reduction distribution in the circumferential direction meets the condition of the following formula (1);

$$[(\max A_3)-(\min A_3)]/(\text{ave } A_3)<0.1 \quad (1)$$

wherein $A_3$ indicates the rolling reduction represented by $$(t_1-t_3)/t_1$$

where $t_1$: wall thickness after rolling through the first stand $t_3$: wall thickness after rolling through the third stand According to another aspect of the invention, the rolling in the second stand is conducted by using rolls defining said roll groove such that the ratio between the radius of curvature of the groove bottom and the distance between the bottoms of the groove ranges from 0.48 to 0.52, and that the rolling by the fourth stand is conducted such that the rolling reduction distribution in the circumferential direction meets the condition of the following formula (2):

$$[(\max A_4)-(\min A_4)]/(\text{ave } A_4)<0.1 \quad (2)$$

wherein $A_4$ indicates the rolling reduction represented by $$(t_2-t_4)/t_2$$

where $t_2$: wall thickness after rolling through the second stand $t_4$: wall thickness after rolling through the fourth stand The invention may be carried out such that the rollings are conducted in the first and second stands using the rolls according to the first and second aspects, followed by rolling in the third and fourth stands so as to provide rolling reductions as defined by the formulae (1) and (2).

The reasons of limiting the rolling reductions to the ranges specified above will now be described.

Figure 4:
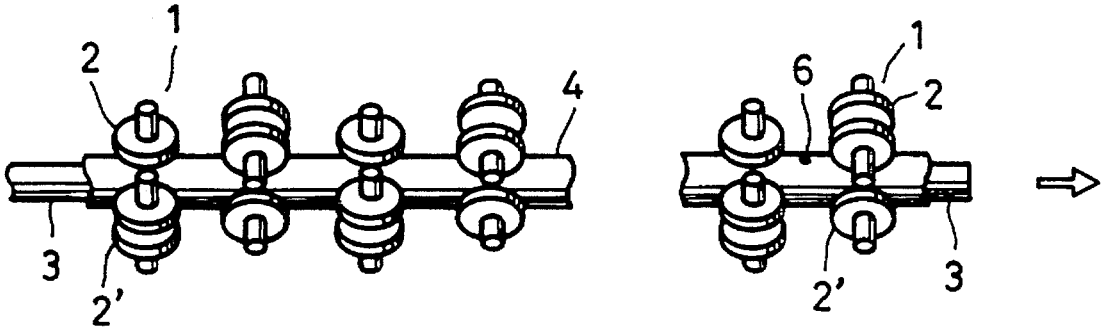
FIG. 4 is a schematic drawing of a mandrel mill.
Figure 5:
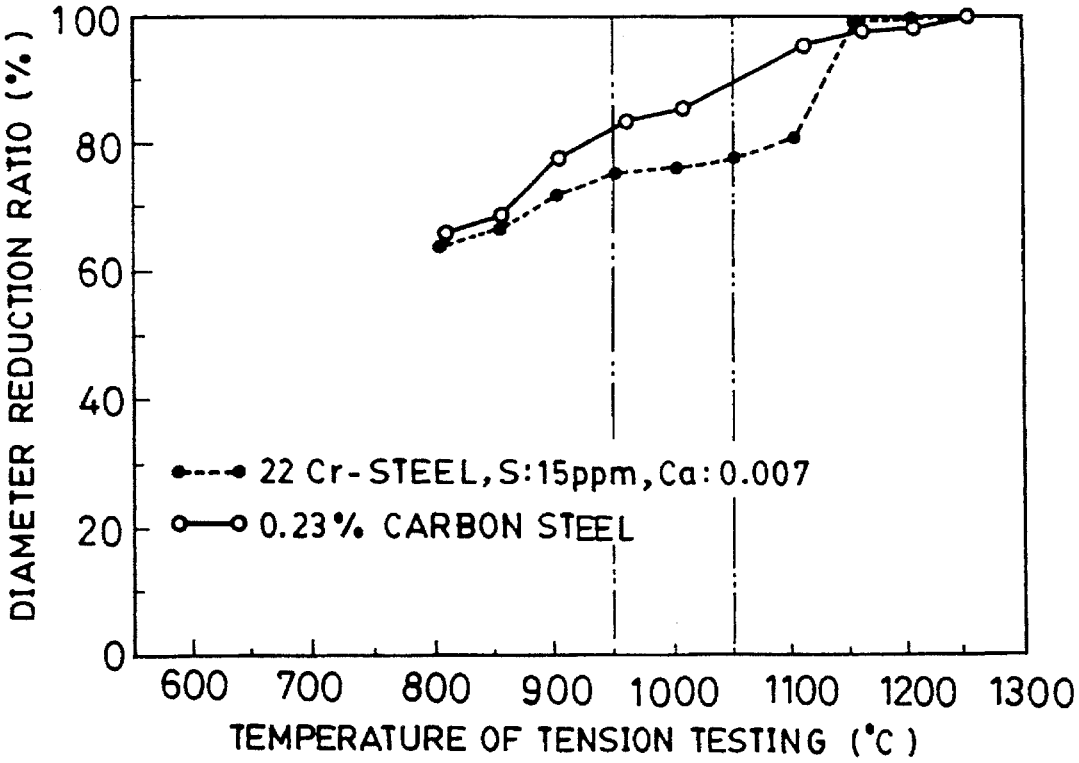
FIG. 5 is a diagram illustrating hot working characteristics.

As shown in FIG. 4, a mandrel mill has a plurality of roll stands which are arranged such that the roll axes of adjacent stands are orthogonal to each other.

Tube wall portions which have been rolled down through a rolling stand are not rolled in the next rolling stand because riley face flange portions of the rolls, so that the wall thickness remain unchanged. These portions are then rolled in the roll stand which is downstream of the above-mentioned next roll stand as these portions are pressed by the bottoms of the roll grooves.

Figure 6:
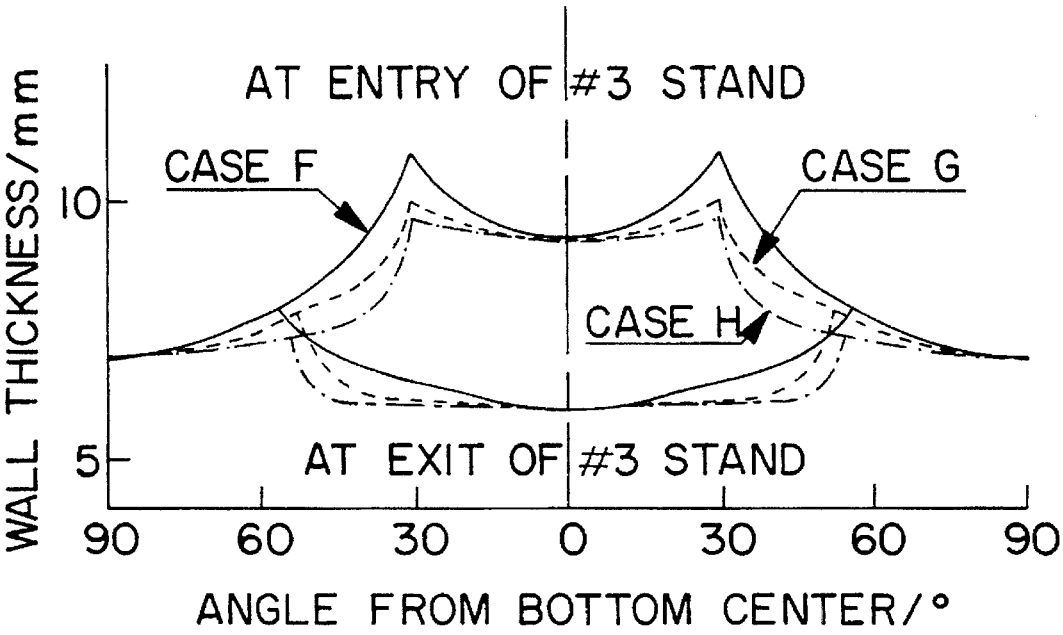
FIG. 6 is an illustration of circumferential distributions of wall thickness at the inlet and outlet sides of the third stand.

For instance, the circumferential wall thickness distributions at the inlet and outlet sides of the third stand are determined by the configurations of the roll grooves in the first, second and third stands and the diameter of the mandrel bar. FIG. 6 shows examples of the circumferential wall thickness distributions at the inlet and outlet sides of the third stand. The axis of abscissa represents the region of the roll groove in terms of the angle formed around the center of the arc of the groove cross-section. The angle 0° corresponds to the bottom of the groove. The range of ±30° indicates the region which has been rolled in the first stand by the portions of the roll groove having the radius of curvature R1. Curves indicated at Case F, Case G and Case H respectively correspond to the cases F, G and H shown in table 5 which employ different values of a factor β which is double the ratio between the radius R1 of curvature of the groove bottom and the distance U between the groove bottoms (β=2×R1/B) for each of the first to eighth rolling stands. In the case F, the value of the above-mentioned factor D is large, i.e., R1=0.573×B. In this case, the wall thickness at the outlet of the first stand is minimum at the center of the groove bottom and increases progressively away from the center of the groove bottom, thus exhibiting non-uniform circumferential distribution of the wall thickness. Uniform wall-thickness distribution at the groove bottom in the circumferential direction is obtained when the value of the above-mentioned factor β is small, i.e., R1=0.518×B as in Case H, so as to make the center of R1 approach the path center.

TABLE 5

Conditions of Experiment for Effect of Groove Bottom Radius on shell defects

| | Stand No. | | | | | | | |
|---|---|---|---|---|---|---|---|---|
| | #1 | #2 | #3 | #4 | #5 | #6 | #7 | #8 |
| α | 1.140 | 1.070 | 1.030 | 1.020 | 1.020 | 1.020 | 1.020 | 1.000 |
| | | | | β | | | | |
| Case F | 1.146 | 1.066 | 1.034 | 1.000 | 1.000 | 1.000 | 1.000 | 1.000 |
| Case G | 1.060 | 1.042 | 1.011 | 1.000 | 1.000 | 1.000 | 1.000 | 1.000 |
| Case H | 1.036 | 1.019 | 1.010 | 1.010 | 1.000 | 1.000 | 1.000 | 1.000 |

Figure 7:
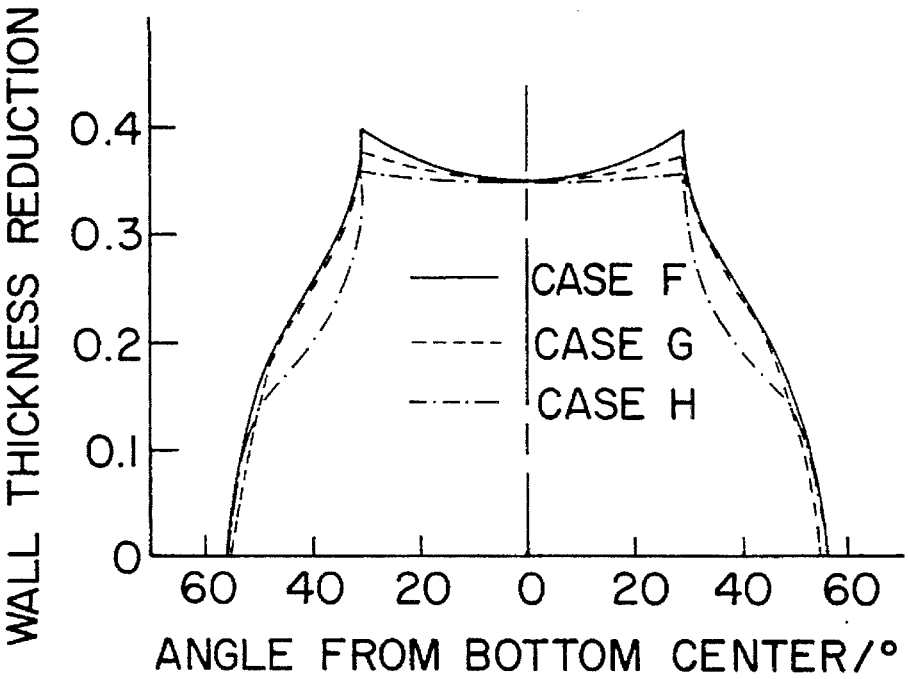
FIG. 7 is the illustration of circumferential distributions of wall thickness rolling reduction at the inlet and outlet sides of the third stand.

It is possible to determine wall thickness reduction ratio from the wall thickness distributions at the inlet and outlet sides of the third stand shown in FIG. 6. The definition of the reduction ratio follows the formulae (1) and (2) mentioned before. The results of the determination are shown in FIG. 7. FIG. 7 shows the circumferential distribution of the wall thickness reduction ratio at the third stand. In FIG. 7, the axis of abscissa represents the angle of region of the roll groove. The value 0° corresponds to the bottom of the groove. The range of ±30° is the portion which has been rolled by the region of radius R1 in the first stand. When the first stand has a large value of the factor β as in Case F, the rolling reduction in the third stand is such that the reduction ratio is smaller at the center of the groove bottom than at the regions on both sides of the center. The central portion of the groove bottom, which has been rolled to have a small thickness before entering the third stand and which is rolled at a small rolling reduction in the third stand, cannot follow longitudinal elongation of the regions on both sides of the center which are rolled at greater rolling reduction. Consequently, the central region of the grove bottom is locally stressed by tensile stresses so that perforating shell defect is caused. When the value of the factor β is reduced to approach 1, i.e., to meet the condition of R1=0.5×B, a uniform circumferential distribution of rolling reduction is realized in the third stand, so that generation of perforation shell defect at the central region of the groove bottom is avoided. Referring to FIG. 7, in Case F, the maximum reduction ratio and the minimum reduction ratio are respectively 0.4 and 0.35 in the region of ±30°, i.e., in the region which has been rolled by the portion of the radius R1 of the rolls in the first stand.

In this case, the circumferential rolling reduction distribution in accordance with the formula (1) is calculated as follows:

[(max reduction ratio)−(min reduction ratio)]/(ave reduction ratio)=0.13

In this case, therefore, perforating shell defect is unavoidable.

variation in the rolling reduction is small in Cases G and H, as compared with Case F. Namely, the circumferential distributions of the reduction ratio in the third stand are as follows in Cases G and H:

Case G:

[(max reduction ratio)−(min reduction ratio)]/(ave reduction ratio)=0.06

Case G:

[(max reduction ratio)−(min reduction ratio)]/(ave reduction ratio)=0.03

In these cases, the circumferential distributions of the rolling reduction are not greater than 0.1, thus minimizing the generation of perforating shell defect.

Thus, generation of perforating shell defect can greatly be suppressed when the rolling in the third stand is conducted in such a manner as to meet the condition of:

[(max reduction ratio)−(min reduction ratio)]/(ave reduction ratio)<0.1

It is, however, not possible to completely eliminate the generation of perforating shell defect solely by meeting the above-mentioned condition in the third stand. According to the invention, it is possible to completely prevent generation of perforating shell defect by determining the configurations of the rolling grooves in the second and fourth stands taking into consideration the value of the factor β and the rolling reductions such that the condition represented by the formula (2) is met.

By adopting the rolling conditions as described hereinbefore, it has become possible to form a seamless steel tube having a shell wall thickness-to-outside diameter ratio of 0.025 or less by from a high-alloy material such as austenitic stainless steel by using a mandrel mill instead of the conventionally used hot extrusion method. When a carbon steel is used as the material, the minimum wall thickness of seamless steel tube obtainable at the outlet side of the mandrel mill can be reduced by 1 mm as compared with the conventional case.

Embodiment 1

Rolling conditions and results of a mandrel mill using a tube material of a plain carbon steel according to the present invention are exhibited in Tables 1 and 2 respectively. In the rolling conditions of the present invention, the ratios between the groove bottom radius of curvature of the roll groove and the distance-between the groove-bottom formed by the pair of rolls in the first and second stands are set as 0.54 and 0.52 respectively. On the other hand, in the rolling conditions of the prior art, the ratios between the groove bottom radius of curvature of the roll groove and the distance between the groove bottom-formed by the pair of rolls in the first and second stands are set as 0.6 and 0.55 respectively. In this case, the circumferential distribution of the rolling reduction in the rolling region of the third stand, expressed by [(max $A_3$)−(min $A_3$)]/(ave $A_3$) was 0.13 in the case of the known art and 0.06 in the invention. At the same time, the circumferential distribution of the rolling reduction in the rolling region of the fourth stand, expressed by [(max $A_4$)−(min $A_4$)]/(ave $A_4$) was 0.11 in the case of the known art and 0.04 in the invention.

TABLE 1

| | The Present Invention | | The Prior Art | |
|---|---|---|---|---|
| Stand No. | G.B.R.C.*1 R1 | D.G.B.*2 | G.B.R.C. R1 | D.G.B. B |
| 1 | 99.1 | 183.5 | 110.1 | 183.5 |
| 2 | 93.1 | 179.0 | 98.5 | 179.0 |
| 3 | 89.2 | 176.8 | 89.2 | 176.8 |
| 4 | 87.8 | 175.6 | 87.8 | 175.6 |
| 5 | 87.3 | 174.5 | 87.3 | 174.5 |
| 6 | 87.3 | 174.5 | 87.3 | 174.5 |
| 7 | 87.3 | 174.5 | 87.3 | 174.5 |
| 8 | 90.0 | 180.0 | 90.0 | 180.0 |

(*1 G.B.R.C.: Groove Bottom Radius of Curvature)
(*2 D.G.B.: Distance between the Groove Bottom)
Diameter of employed mandrel bar: 166.5 mm
Rolling material: Plain carbon steel
Dimension at the mill exit: Outer diameter 180 mm, Wall thickness 4 mm, Length 24 m

TABLE 2

| | Rolling by the Present Invention | Rolling by the Prior Art |
|---|---|---|
| Number of Tubes Having "Hole Defect" | None out of 200 tubes | 44 out of 200 tubes |

According to the present invention, it is understood that plain carbon steel with dimension of the outer diameter of 180 mm and wall thickness of 4 mm at the exit of the mandrel mill can be manufactured without "hole defect."

Embodiment 2

Rolling conditions and results of a mandrel mill using a tube material of 13% Cr-steel according to the present invention are exhibited in Tables 3 and 4, respectively. In the rolling conditions of the present invention, the ratios between the groove bottom radius of curvature of the roll groove and the distance between the groove bottom formed by the pair of rolls in the first and second stands are set as 0.54 and 0.52, respectively. On the other hand, in the rolling conditions of the prior art, the ratios between the groove bottom radius of curvature of the roll groove and the distance between the groove bottom formed by the pair of rolls in the first and second stands are set as 0.6 and 0.55, respectively. In this case, the circumferential distribution of the rolling reduction in the rolling region of the third stand, expressed by [(max $A_3$)−(min $A_3$)]/(ave $A_3$) was 0.13 in the case of the known art and 0.06 in the invention. At the same time, the circumferential distribution of the rolling reduction in the rolling region of the fourth stand, expressed by [(max $A_4$)−(min $A_4$)]/(ave $A_4$) was 0.11 in the case of the known art and 0.04 in the invention.

TABLE 3

| | The Present Invention | | The Prior Art | |
|---|---|---|---|---|
| Stand No. | G.B.R.C.*1 R1 | D.G.B.*2 | G.B.R.C. R1 | D.G.B. B |
| 1 | 99.1 | 183.5 | 110.1 | 183.5 |
| 2 | 93.1 | 179.0 | 98.5 | 179.0 |
| 3 | 89.2 | 176.8 | 89.2 | 176.8 |
| 4 | 87.8 | 175.6 | 87.8 | 175.6 |
| 5 | 87.3 | 174.5 | 87.3 | 174.5 |
| 6 | 87.3 | 174.5 | 87.3 | 174.5 |
| 7 | 87.3 | 174.5 | 87.3 | 174.5 |
| 8 | 90.0 | 180.0 | 90.0 | 180.0 |

(*1 G.B.R.C.: Groove Bottom Radius of Curvature)
(*2 D.G.B.: Distance between the Groove Bottom)
Diameter of employed mandrel bar: 164.5 mm
Rolling material: 13% Cr-steel
Dimension at the mill exit: Outer diameter 180 mm, Wall thickness 4 mm, Length 24 m

TABLE 4

| | Rolling by the Present Invention | Rolling by the Prior Art |
|---|---|---|
| Number of Tubes Having "Hole Defect" | None out of 200 tubes | 30 out of 200 tubes |

According to the present invention, it is understood that a 13% Cr-steel with dimension of the outer diameter of 180 mm and wall thickness of 4 mm at the exit of the mandrel mill can be manufactured without a "hole defect."

Therefore, to carry out the present invention, it is not necessary to provide a new device for an existing mandrel mill.

According to the present invention, a "hole defect", which conventionally has occurred at the groove bottom center portion in a roll groove, can be successfully prevented by designing the groove bottom radius of curvature of the roll groove at the first and second stands in the mandrel mill. Thus, a remarkable effect is obtained for preventing a "hole defect" in mandrel mill rolling especially for tubes with thin wall-thickness and for a high alloy steel having an inferior deformability.

What is claimed is:

1. A method of producing a thin-walled seamless steel tube having a wall thickness-to-outside diameter ratio of 0.025% or less by rolling a seamless steel tube in a mandrel mill which comprises at least first, second, third, and fourth sequential stands each having a pair of rolls defining a roll groove therebetween, said roll stands being arranged such that the axes of rolls of each roll stand extend orthogonally to the axes of rolls of each adjacent roll stand, and a mandrel bar disposed in the roll grooves configured by said roll stands, said method characterized in that the rolling in the first stand is conducted by using rolls defining a roll groove such that a ratio between a radius of curvature of a groove bottom and a distance between bottoms of the groove ranges from 0.46 to 0.54, and that the rolling by the third stand is conducted such that rolling reduction distribution in a circumferential direction meets the condition of the following formula (1):

$$[(\max A_3)-(\min A_3)]/(\text{ave } A_3) < 0.1 \quad (1)$$

wherein $A_3$ indicates rolling reduction represented by $$(t_1-t_3)/t_1$$

where $t_1$: wall thickness after rolling through the first stand $t_3$: wall thickness after rolling through the third stand.

2. A method of producing a thin-walled seamless steel tube having a wall thickness-to-outside diameter ratio of 0.025% or less by rolling a seamless steel tube in a mandrel mill which comprises at least first, second, third and fourth sequential stands each having a pair of rolls defining a roll groove therebetween, said roll stands being arranged such that axes of rolls of each roll stand extend orthogonally to axes of rolls of each adjacent roll stand, and a mandrel bar disposed in the roll grooves configured by said roll stands, said method characterized in that the rolling in the second stand is conducted by using rolls defining a roll groove such that a ratio between a radius of curvature of a groove bottom and a distance between bottoms of the groove ranges from 0.48 to 0.52, and that the rolling by the fourth stand is conducted such that rolling reduction distribution in a circumferential direction meets the condition of the following formula (2):

$$[(\max A_4)-(\min A_4)]/(\text{ave } A_4) < 0.1 \quad (1)$$

wherein $A_4$ indicates rolling reduction represented by $$(t_2-t_4)/t_2$$

where $t_2$: wall thickness after rolling through the second stand $t_4$: wall thickness after rolling through the fourth stand.

3. A method of producing a thin-walled seamless steel tube having a wall thickness-to-outside diameter ratio of 0.025% or less by rolling a seamless steel tube in a mandrel mill which comprises at least first, second, third and fourth sequential stands each having a pair of rolls defining a roll groove therebetween, said roll stands being arranged such that axes of rolls of each roll stand extend orthogonally to axes of rolls of each adjacent roll stand, and a mandrel bar disposed in the roll grooves configured by said roll stands, said method characterized in that the rolling in the first stand is conducted by using rolls defining a roll groove such that a ratio between a radius of curvature of a groove bottom and a distance between the bottoms of groove ranges from 0.46 to 0.54, and that the rolling by the third stand is conducted such that rolling reduction distribution in a circumferential direction meeks the condition of the following formula (1):

$$[(\max A_3)-(\min A_3)]/(\text{ave } A_3) < 0.1 \quad (1)$$

wherein $A_3$ indicates rolling reduction represented by $$(t_1-t_3)/t_1$$

where $t_1$: wall thickness after rolling through the first stand $t_3$: wall thickness after rolling through the third stand and in that the rolling in the second stand is conducted by using rolls defining a roll groove such that the ratio between a radius of curvature of a groove bottom and a distance between bottoms of the groove ranges from 0.48 to 0.52, and that the rolling by the fourth stand is conducted such that rolling reduction distribution in a circumferential direction meets the condition of the following formula (2):

$$[(\max A_4)-(\min A_4)]/(\text{ave } A_4)<0.1 \quad (2)$$

wherein $A_4$ indicates rolling reduction represented by $$(t_2-t_4)/t_2$$

where $t_2$: wall thickness after rolling through the second stand $t_4$: wall thickness after rolling through the fourth stand.

* * * * *